US007032358B2

(12) United States Patent
Dall'omo

(10) Patent No.: US 7,032,358 B2
(45) Date of Patent: Apr. 25, 2006

(54) DEVICE FOR CLOSING THE SIDE ENDS OF A PACKAGE ENCLOSING ONE ROLL OR ROLLS OF MATERIAL IN AN AUTOMATIC PACKAGING MACHINE

(75) Inventor: Davide Dall'omo, Bologna (IT)

(73) Assignee: Tissue Machinery Company S.p.A., Granarolo Emillia (IT)

( * ) Notice: Subject to any disclaimer, the term of this patent is extended or adjusted under 35 U.S.C. 154(b) by 10 days.

(21) Appl. No.: 10/945,657

(22) Filed: Sep. 21, 2004

(65) Prior Publication Data

US 2005/0060954 A1 Mar. 24, 2005

(30) Foreign Application Priority Data

Sep. 24, 2003 (IT) ..... B02003A0052

(51) Int. Cl.
*B65B 11/06* (2006.01)

(52) U.S. Cl. ..... 53/230; 53/216; 53/217; 53/227; 53/370

(58) Field of Classification Search ..... 53/204, 53/211, 216, 227, 228, 230, 232, 233, 370, 53/374.5

See application file for complete search history.

(56) References Cited

U.S. PATENT DOCUMENTS 2,113,078 A * 4/1938 Campbell ..... 53/409
2,301,016 A * 11/1942 Cannard ..... 53/204
2,644,282 A 7/1953 Irvine
2,938,319 A 5/1960 Ernst
3,303,630 A * 2/1967 Harm ..... 53/443
4,624,096 A * 11/1986 Nordstrom ..... 53/209
4,651,500 A * 3/1987 Chaffey ..... 53/204
5,771,659 A * 6/1998 Hansen ..... 53/370.7
6,067,780 A * 5/2000 Gentili et al. ..... 53/504
6,192,656 B1 * 2/2001 Takahashi ..... 53/409
6,688,082 B1 * 2/2004 Loperfido et al. ..... 53/461
6,691,492 B1 * 2/2004 Gamberini ..... 53/230
6,889,486 B1 * 5/2005 Christian ..... 53/466
6,935,091 B1 * 8/2005 Gamberini ..... 53/466
2002/0059779 A1 * 5/2002 Gamberini ..... 53/228

* cited by examiner

*Primary Examiner*—Stephen P. Gerrity
*Assistant Examiner*—Thanh Truong
(74) *Attorney, Agent, or Firm*—William J. Sapone; Coleman Sudol Sapone P.C.

(57) ABSTRACT

In a device for closing side ends of packages enclosing only one roll or one row of rolls in an automatic packaging machine, operating apparatus are connected to the machine packaging line. A package, partially wrapped by a sheet, is fed to the packaging line in a forward direction, so that only the outer cylindrical surface of the package is touched by the operating apparatus. The operating apparatus translate and rotate the package about an axis, in the forward direction, so that edges of the sheet wrapping the package, during transferring along said packaging line, hit edges of stationary folding apparatus situated beside the packaging line, and become twisted.

12 Claims, 6 Drawing Sheets

DEVICE FOR CLOSING THE SIDE ENDS OF A PACKAGE ENCLOSING ONE ROLL OR ROLLS OF MATERIAL IN AN AUTOMATIC PACKAGING MACHINE

FIELD OF THE INVENTION

The present invention relates to packaging articles into a film wrapped and stretched therearound to form a protective envelope. In particular, the present invention relates to packaging materials wound around a central rigid core, such as paper towels, rolls of toilet paper or other type of tissue paper, entirely wrapped by a protective sheet or a film of flexible material.

More precisely, the present invention relates to a device for closing side ends of a package formed by only one roll or by a number of rolls arranged coaxially and set head by head, to form a single row, in an automatic packaging machine.

DESCRIPTION OF THE PRIOR ART

Packaging machines for obtaining packages formed by e.g. preferably by only one roll or by one row of rolls, include, as it is known, an initial working station fed intermittently with a roll to be packaged, or with a series of rolls to be packaged, which are arranged coaxial and set head by head, to form a one-row pack of rolls.

The group of rolls being packaged, formed as described above by only one roll or only one row of rolls, is conveyed from the initial working station to the inlet section of a package completion station, commonly identified as the actual packaging line.

During transferring from the initial station to the inlet section of the packaging line, the group of rolls hits a wrapping sheet and draws it to partially wrap its surface in a known way.

Then, folding means fold the sheet edges on the remaining lateral surface, to complete the wrapping of the whole package.

Sealing means (which in case of sheet of heat-weldable material, for example polythene, include heat-welding means), seal the edges together.

At this point, the package has got a tubular shape with side edges protruding beyond the side ends of the package and still open.

Then, the package is conveyed along the packaging line, to fold and close the side ends, in order to finish the package, which is performed by stationary folding means situated beside the forward moving line.

According to techniques currently used, the side edges of the wrapping sheet are folded and then closed preferably in two different ways: according to a first traditional closing way, the sheet side edges are folded perpendicular to each other, to adhere to the side ends of the package, while according to a second way, the entire sheet side edged are twist-folded, so that they become twisted, and then the twisted sheet edges are made to adhere to the package side ends.

In the specific technical field identified above, the packages obtained according to the side edges closing technique with twisting effect, are shapely and generally appreciated by buyers and consumers.

Therefore, it is of strategic importance for the producers of the packaging machines to equip the latter with suitable devices which close the packages sides by this folding technique.

However, there are different problems connected with this folding operation, which derive mainly from the particular motion required for the roll or group of rolls and the sheet wrapped around it, with respect to the stationary folding means situated therebeside.

In fact, in order to fold the side edges with a twisting effect, it is necessary to impart the package formed by the roll or group of rolls and wrapping sheet with a combined rotation-translation motion with respect to the stationary folding means.

The rotation-translation of the sheet side edges against the edges of the stationary folding means wraps and twists the side edges, thus obtaining the twist-folding effect.

Known devices for this kind of motion include means acting directly on the side ends of the package, entering the ends of the inner core of the roll, or of the extreme rolls of the row of rolls.

These means, having a cone-like shape, are situated beside the packaging line and are moved from a far-from-the-packaging-line configuration to a close-to-the-packaging-line configuration, so as to enter the core of the roll or the cores of the external rolls of the row of rolls.

These means can be also operated such to translate, parallel to the packaging line, and to rotate about their axis.

The combination of the cone-like means rotation-translation motion moves the roll or rolls group in the rotation-translation as well, along the packaging line; consequently, the ends of the package are contacted by the lateral stationary folding means and are twist-folded on themselves over the outer surface of the cone-like means.

However, particularly serious disadvantages derive from the fact that after the twist-folding, the cone-like means must be removed from the roll core, or from the cores of the external rolls of the roll row, and moved far from the line, to allow suitable sealing means to complete the side ends closing.

This causes considerable difficulties in the packaging machine design, first of all regarding free working spaces beside the packaging line for operation of the cone-like means, and the positioning of the stationary folding means, which must have vertically limited dimension to allow the cone-like means to pass through the sheet edges until they are completely introduced into the roll core (or into the cores of the external rolls of the roll row).

Moreover, the reduced dimension of the stationary folding means can negatively affect the folding action efficiency.

It is also to be pointed out that a packaging machine equipped with the cone-like means, situated beside the packaging line, for making twist-folding, is not versatile, that is it cannot be used with different roll arrangements, that is for packaging of groups formed by more rows of rolls, arranged one beside another or one over another.

SUMMARY OF THE INVENTION

Therefore, the object of the present invention is to propose a device which can be used in automatic packaging machines for closing the side ends of packages formed by only one row of rolls, with twist-folding effect, without any of the disadvantages mentioned before.

More in detail, the main object of the present invention is to propose a device, which closes the packages side ends by twist-folding in a functional and efficient way, without necessity of working spaces beside the packaging line for positioning working means which move the package formed by the roll or group of rolls and the sheet wrapped thereon, with a rotation-translation motion.

Another object of the present invention, connected with the previous one, is to propose a device which allows the use of freely dimensioned folding means not limited a priori by technical-functional requirements.

A further object of the present invention is to propose a device which is a particularly advantageous solution as far as the costs are concerned, as well as technical functionality, because it makes the packaging machine, to which it is connected, particularly versatile, thus allowing its use also in case of packages with rolls arranged differently.

The above mentioned objects are obtained, in accordance with the contents of the claims, by a device for closing the side ends of packages enclosing one roll or one row of rolls of material, in an automatic packaging machine, with said packaging machine including:

a station for preparing a roll or a row of rolls arranged one beside another to be packaged by wrapping with a sheet of flexible material to form a protective wrapping;

means for transferring said roll or row of rolls from said preparing station to an inlet section of a packaging line, operated in a forward movement direction;

means for positioning a packaging sheet in stretched configuration and crosswise to the transfer path of said roll or row of rolls from said preparing station to said inlet section, and wrapping means and folding means of said sheet, situated along said transfer path, to wrap the sheet around said roll or row of rolls to form a tubular partial package with edges of said sheet extending sideways beyond the side ends of the package still open, with said inlet section transferring said partial package to the packaging line with the side ends of the package being parallel to said forward movement direction;

the device is characterized in that it includes operating means, which are connected to said packaging line and touching only an outer cylindrical surface of said package, and stationary folding means, situated beside said packaging line and extending along a part of the entire length of the packaging line, in such a configuration that they can be hit only by said side ends of said package, with said operating means acting on said outer cylindrical surface to translate and rotate said package, in said forward movement direction, so that said side ends, during the motion of said package along said packaging line, hit, in rotation-translation, edges of said stationary folding means, thus becoming twisted.

BRIEF DESCRIPTION OF THE DRAWINGS

The characteristic features of the invention, as they will result from the claims, are pointed out in the following description of a preferred embodiment of a device for closing side ends of packages formed by only one row of rolls in an automatic packaging machine, given as an example with reference to the enclosed drawings, in which:

DISCLOSURE OF THE PREFERRED EMBODIMENTS

With reference to the enclosed figures, reference letter D indicates generally the device for closing side ends, with twist-folding effect, of packages formed by one row of rolls in an automatic packaging machine, proposed by the present invention.

The enclosed figures show, as a mere example, the packaging of a single roll. However, the device D can be used, as it has been already pointed out, also in case of packages formed by a series of rolls, coaxial and situated head by head to form one row of rolls.

Figure 1:
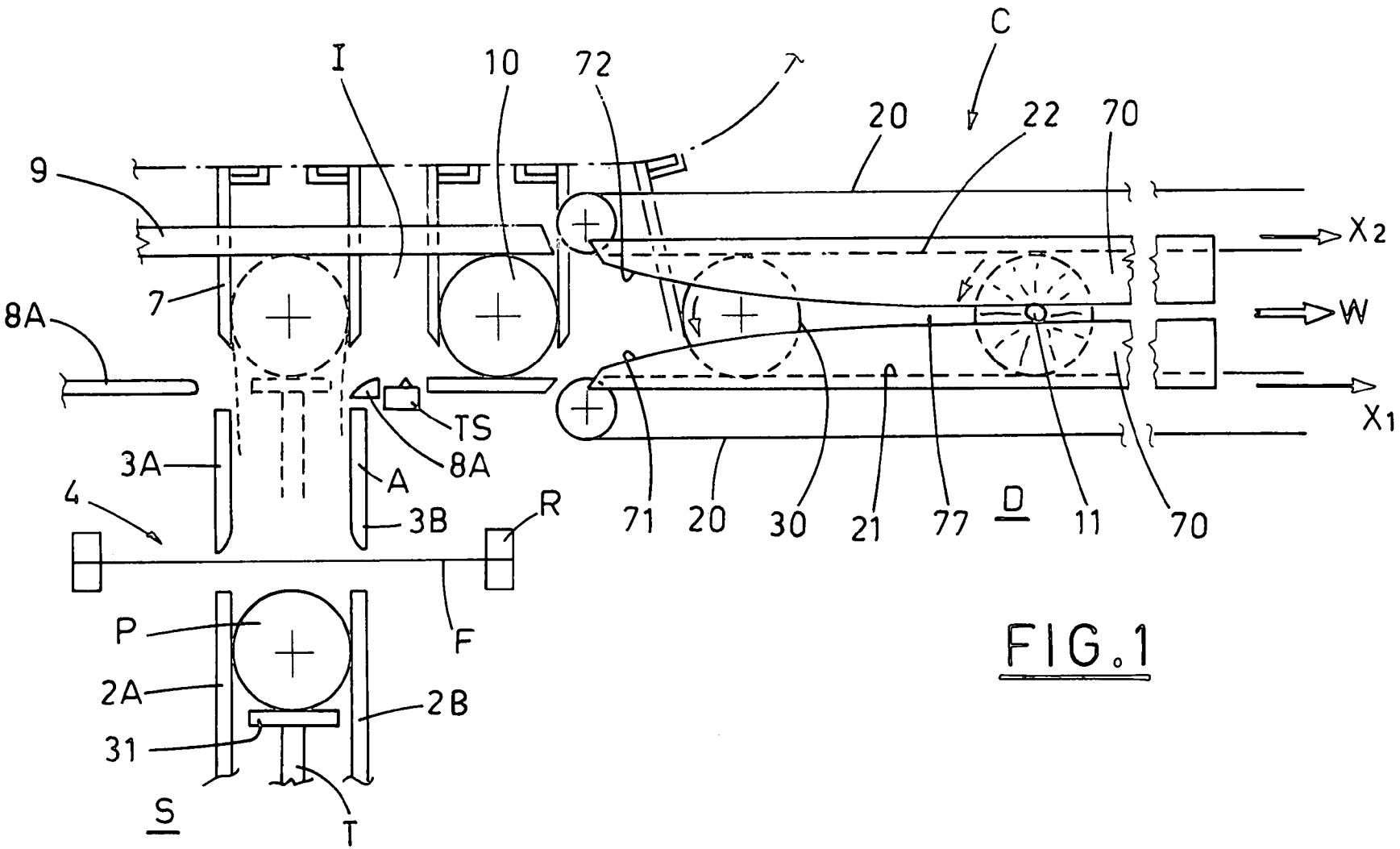
FIG. 1 is a schematic, lateral view of the device for closing side ends of packages formed by only one row of rolls, proposed by the present invention, in a first configuration of an automatic packaging machine, to which the device can be mounted.

The proposed device D, whose various parts and operation will be described in detail later on, can be installed on packaging machines of general type, which usually include:

a station S for forming a package by wrapping a sheet F of flexible material around a single roll P or a row of rolls, to form a protective wrapping, as shown in FIG. 1;

means T for transferring the single roll or row of rolls P from the station S to an inlet section I of a packaging line C, operating to move the package in straight forward direction W.

The packaging machines include also:

positioning means R for placing a packaging sheet F in stretched condition, crosswise to the transport path of the roll or row of rolls P from the station S to the inlet section I;

wrapping means A, folding means Q and longitudinal sealing (welding) means TS of the sheet F, situated along the transport path, to wrap the sheet F partially around the cylindrical surface of the roll or row of rolls P, to fold the edges of the sheet F on the remaining unwrapped surface, to complete the wrapping of the whole roll P, and to seal together the longitudinal edges of the sheet F, with definition of a partial package 10 with tubular shape with the side edges 11 of the film protruding beyond the side ends of the package, still open, and with the inlet section I transferring the partial package 10 to the packaging line C while keeping the side ends of the package parallel to the straight movement direction W.

Figure 3:
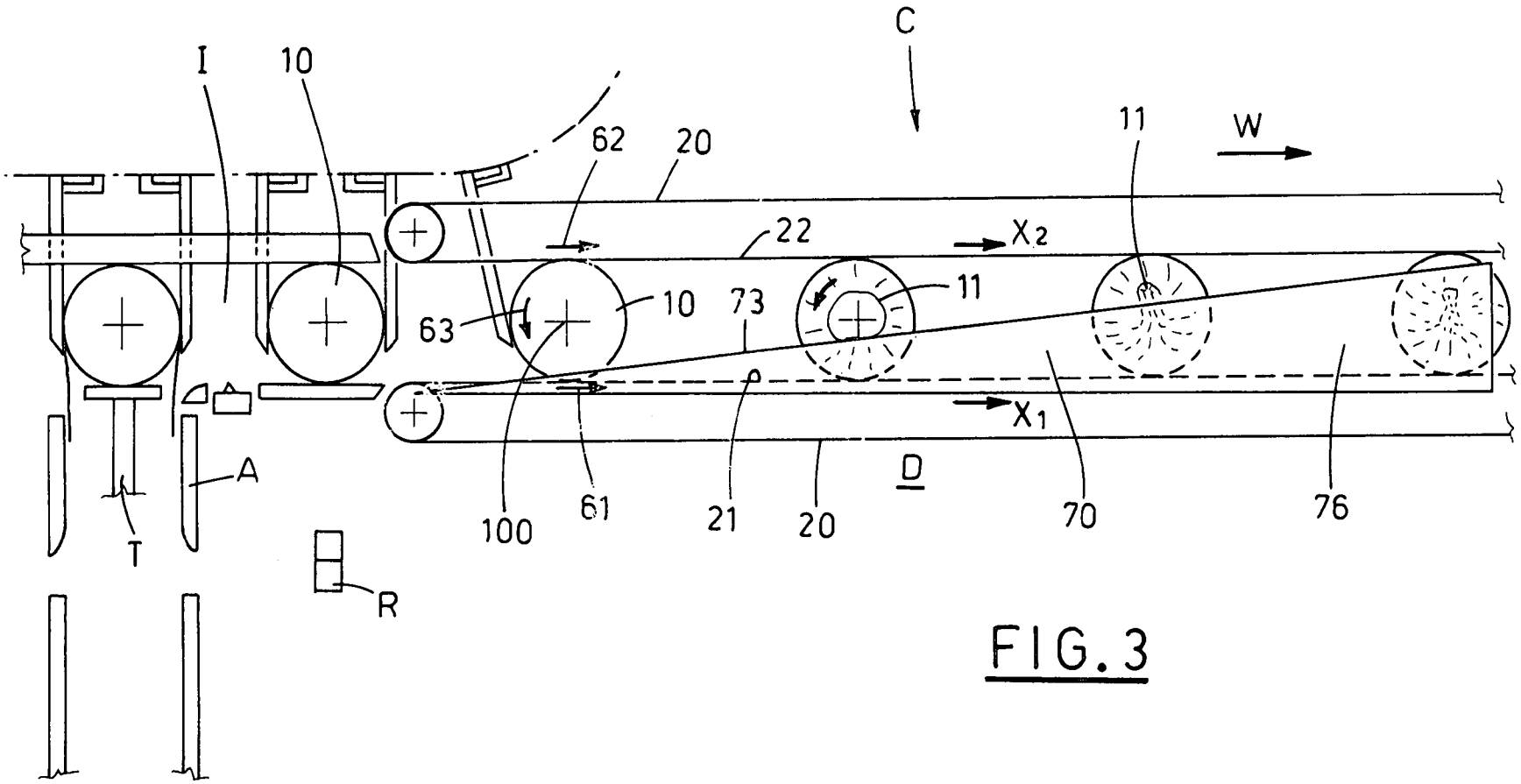
FIG. 3 is a schematic, lateral view of a variant of the device proposed by the present invention connected to an automatic packaging machine of the same configuration as the one shown in FIG. 1, and in case of packaging by flexible heat-weldable material.
Figure 8:
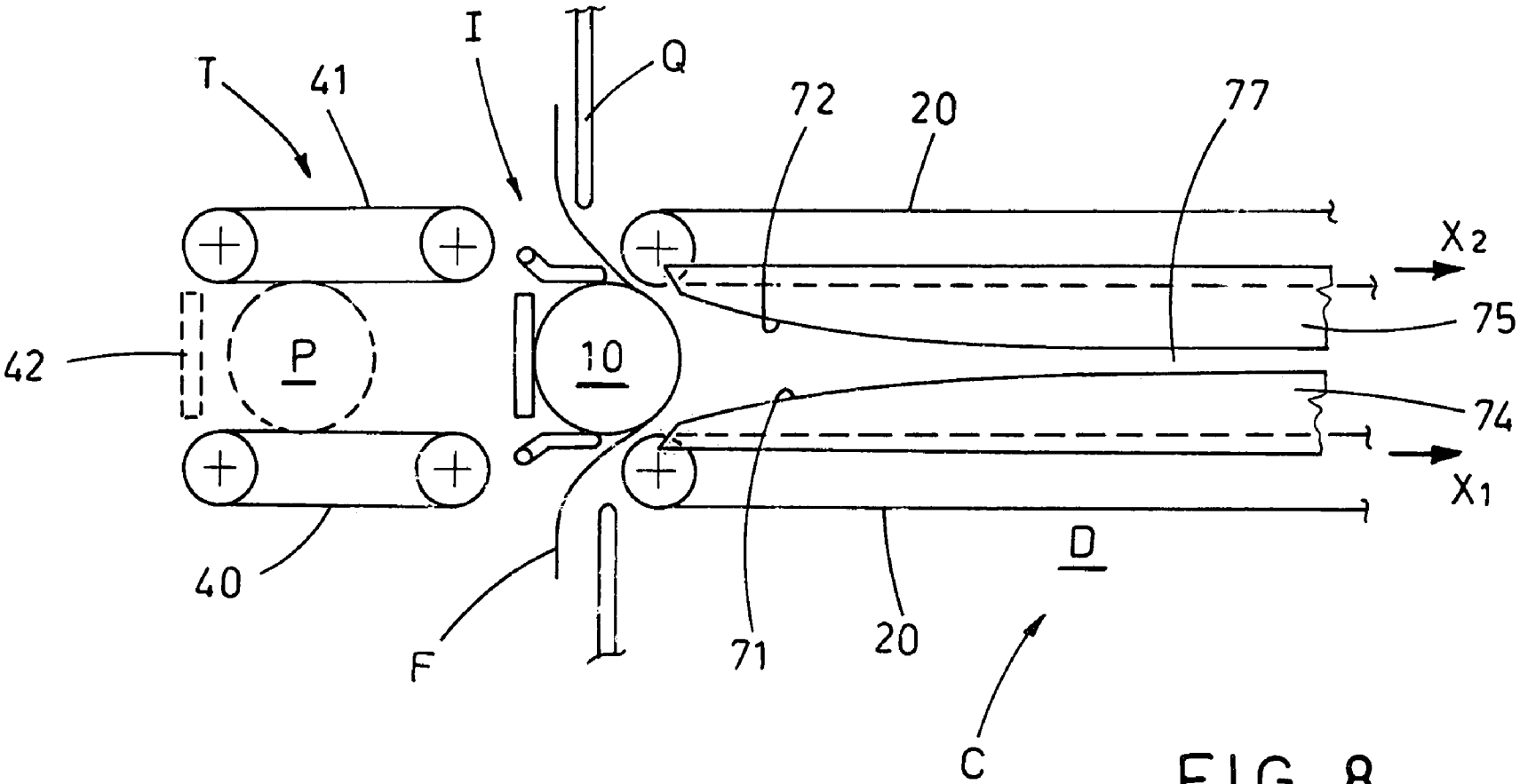
FIG. 8 is a schematic, lateral view of the device for closing the side ends of packages formed by one row of rolls, proposed by the invention, according to another possible configuration of an automatic packaging machine, to which it is connected.

In particular, the device D, proposed by the present invention, can be used in automatic packaging machines, which have a special configuration, as shown respectively in FIGS. 1 and 3, and in FIG. 8, and described respectively in the documents DE 10157992 and DE 10157952.

In detail, with reference to FIGS. 1 and 3, the device D is shown in a packaging machine having a configuration shown in the document DE 10157992.

The machine includes an elevator, having a plate 31, made move vertically between lowered and raised positions.

The plate 31 in lowered position forms the base of the station S for holding the roll P or forming the group of rolls.

The run of the elevator is delimited sideways by two lower lateral opposite guides 2A, 2B, perpendicular to the figure plane, and by two upper lateral opposite guides 3A, 3B, succeeding the previous ones, from which they are set at a distance to define a space 4.

The upper lateral guides 3A, 3B form the wrapping means A of the sheet F.

Means R act in the space 4 for positioning a sheet F, whose dimension is suitable for wrapping a roll or row of rolls P.

Vertical teeth 7 are situated above the outer upper lateral guide 3A (on the left with reference to the figures), and supported by an endless conveyor at a distance from the guide to define a space, in which a first crosswise folder 8A works, cooperating with an opposite second folder 8B, which forms said folding means Q.

A transversal bar 9 is situated above the folders and its height can be adjusted in known way, not shown; the bar acts as abutment for the group formed by the roll or group of rolls P and the sheet F, as well as the elevator 31, which brings the group to the raised position.

The bar 9 and the elevator 31 in the raised position, the folders 8A, 8B, and the vertical teeth 7 define together a station for partial wrapping of the roll or group of rolls P with the sheet F, to define a partial package having a tubular conformation and the side ends open and protruding outwards.

Suitable sealing means TS, situated beside the folder 8B seal together the longitudinal edges of the sheet F.

Then, the endless conveyor conveys, by the teeth 7, the partial package to the inlet section I of the packaging line C.

Further, with reference to FIG. 8, the device D is shown in a packaging machine, whose configuration is shown in the document DE 10157952.

In this case, the machine includes a station S for preparing a roll or a group of rolls, this station including a pair of conveying endless belts 40, 41, adjustable and situated one above another in positions, whose height can vary.

The conveying belts 40, 41 are situated upstream of the packaging line C, arranged in alignment with the same line C, and distanced from the latter, so as to allow feeding of the packaging sheet F in vertical configuration, and positioning of the folding means Q, likewise in vertical configuration, and of the sealing means (not shown in Figure).

The conveying belts 40, 41, together with a pusher 42 acting horizontally therebetween, form said transferring means T which transfer the roll or row of rolls P to contact the sheet F, to wrap the latter around roll or row of rolls. The pusher 42 performs a horizontal stroke such as to transfer the package, together with the sheet F wrapped around it, directly to the inlet section of the packaging line C.

As it has been pointed out previously, the object of the present invention is to propose a device, which can be used in automatic packaging machines, which can close the side ends of the packages, to obtain the twist-folding effect.

Figure 5:
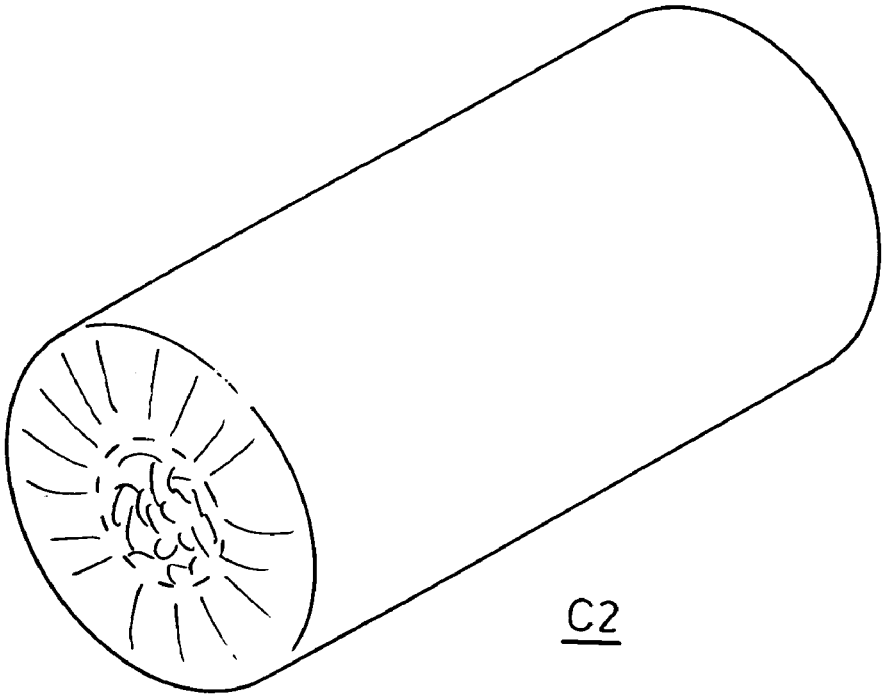
FIG. 5 shows a perspective view of a package formed by one roll, with the protective wrapping made of flexible, heat-weldable material, with the side ends twist-folded by the device proposed by the present invention.

The device D can be used for packaging with either flexible heat-weldable material, obtaining the package C2 shown in FIG. 5, or paper flexible material, obtaining the package Cl shown in FIG. 1.

The device D is characterized by, and differs from the devices used in prior art because it includes: operating means 20, which are connected to the packaging line C, in direct contact only with the outer cylindrical surface 30 of the partial package 10, coming from the inlet section I, and which can act on the partial package 10 to make it translate (61, 62) and rotate (63) on its axis 100, in accordance with the forward movement direction W along the packaging line C, and stationary folding means 70, situated beside the packaging line C, extending along a portion of the entire length of the packaging line, in such a configuration that they can hit only the edges 11, which protrude sideways from the package 10.

The operating means 20 handle the package 10, moving forward along the packaging line C, such that is takes a rotation-translation motion, acting only on its outer cylindrical surface, so that the side edges 11 of the sheet hit the edges 71, 72, 73 of the stationary folding means 70, thus becoming twisted.

According to the preferred embodiment shown in the enclosed figures, the device D includes a pair of endless parallel conveyors, set one above the other, respectively a lower conveyor and an upper conveyor, which define the packaging line C and which receive, between the upper active run 21 of the lower conveyor and the lower active run 22 of the upper conveyor, the partial package 10 coming from the inlet section I.

The upper run 21 of the lower conveyor and the lower run 22 of the upper conveyor tighten between themselves the package 10, touching only the outer cylindrical surface 30 thereof.

For this purpose, the lower conveyor and the upper conveyor are operated by driving means of known type, to adjust reciprocal position thereof, away from or close to each other, in relation to the dimensions of the roll or row of rolls, which form the package.

Moreover, this renders the packaging machine, to which the device D is connected, considerably versatile because a simple variation of the distance between the active runs of the two conveyors can adapt the machine to different sizes of packages to produce.

In order to move the package 10 in the forward movement direction W with a rotation, the upper run 21 of the lower conveyor is operated with an operation speed X1, in a direction 61 identical with the forward movement direction W, different from the operation speed X2 of the lower run 22 of the upper conveyor in a direction 62 likewise identical with the forward movement direction W.

The operation of the conveyors with different speeds allows the package 10, held tightly therebetween, to be translated while rotating along the packaging line C.

For example, the operation speed X1 of the upper run 21 of the lower conveyor can be lower than the operation speed X2 of the lower run 22 of the upper conveyor, or otherwise, the operation speed X1 of the upper run 21 of the lower conveyor can be higher than the operation speed X2 of the lower run 22 of the upper conveyor.

The folding means 70, as for example shown in FIGS. 1, 2, 6 and 8 are situated on both sides of the packaging line C and include a pair of vertical boards, situated one above the other, a lower board 74 and an upper board 75, respectively.

Each board of the pairs of boards 74, 75 is arranged parallel to the forward movement direction W of the packaging line C and, as it has been already said, in such a position with respect to the latter, as to be hit only by the protruding edges 11 of the sheet wrapping the package 10, translated while rotating on the packaging line C by the operating means 20.

The height of the upper edge 71 of the lower board 74 increases continuously, according to the forward movement direction W, from a minimum height value to a maximum height value, smaller than the package 10 radius.

Likewise, the height of the lower edge 72 of the upper board 75 increases continuously, from a minimum height value to a maximum height value, smaller than the package 10 radius and substantially corresponding to the maximum height of the edge 71 of the lower board 74.

In this way, the upper edge 71 of the lower board 74 and the lower edge 72 of the upper board 75 define, beside the packaging line C and in correspondence to their respective maximum heights, a guiding channel 77, which conveys the twisted edges 11 of the sheet wrapping the package 10, during the forward movement of the package 10 along the packaging line C.

This type of folding means 70, 74, 75 can be used in packaging with heat-weldable flexible material, as well as in packaging with paper flexible material.

Figure 2:
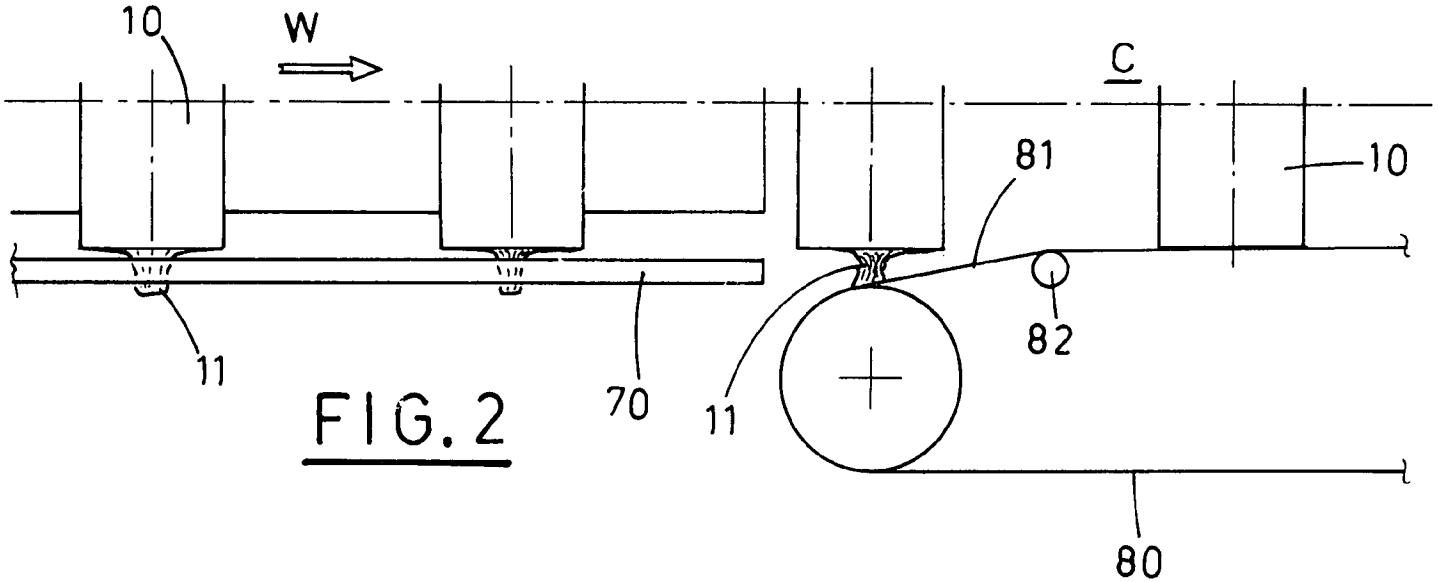
FIG. 2 is a schematic top view of the device shown in FIG. 1.

In the first case, the device D proposed by the invention, includes a pair of endless welding belts 80, situated beside the packaging line C and downstream of the section of the latter relevant to the folding means 70, 74, 75, as schematically shown in FIG. 2.

Each of the welding belts 80 is situated in such a way that its working surface 81 hits the twisted edges 11 of the sheet wrapping the package 10 moving forward along the packaging line C, to heat-weld them and close them in order to complete the package.

It is to be pointed out that the working surface 81 of the welding belts 80 is guided by roll means 82, in abutment against the side ends of the package 10, so as to compact the welded edges 11 against the side ends of the package 10.

The so obtained package C2 is particularly tightened and compact at its side ends, which undergo the desired effect of twist-folding, as shown in FIG. 5.

Figure 6:
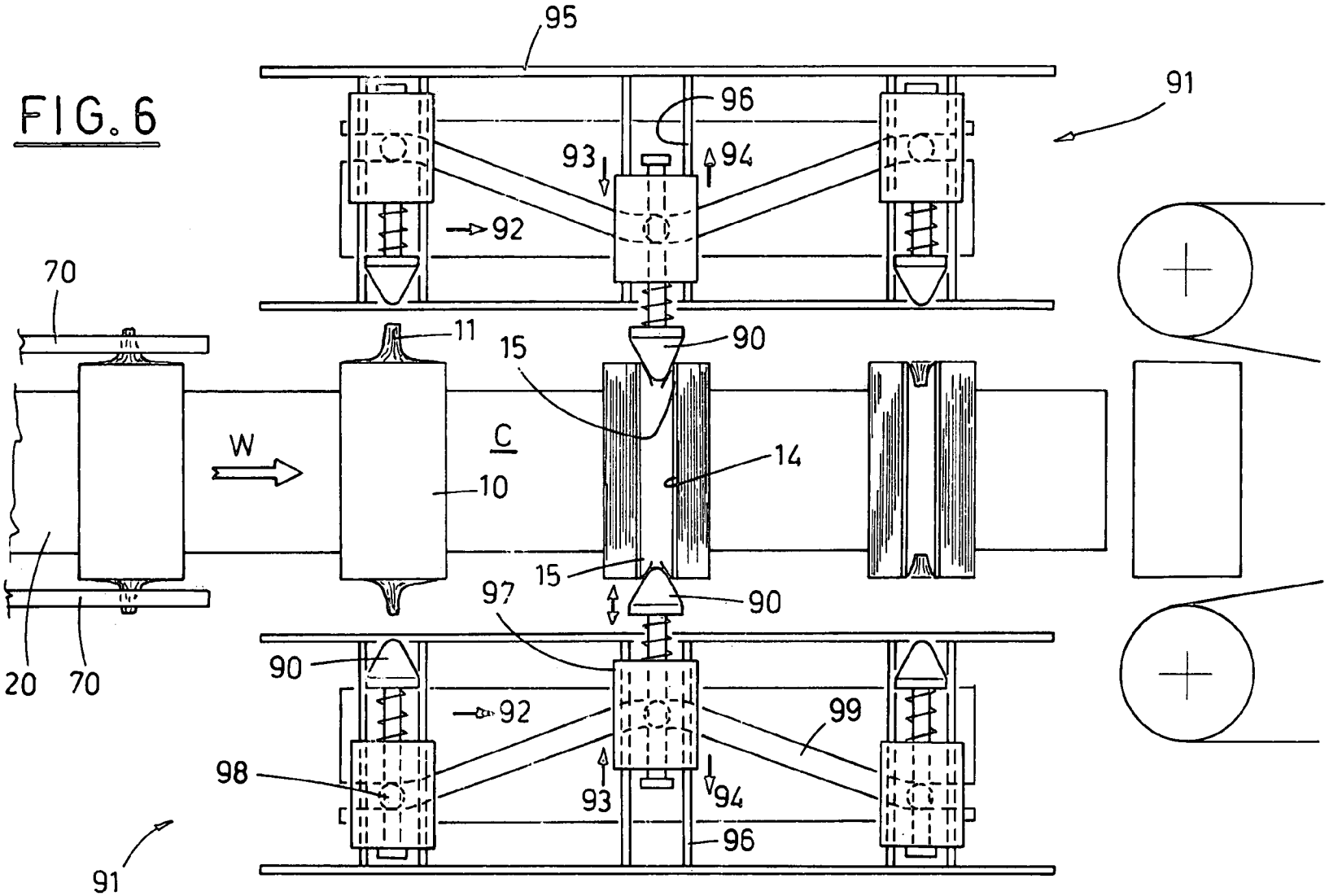
FIG. 6 is a plan view of the device proposed by the present invention connected to an automatic packaging machine, in case of packaging by flexible, paper material.

In the second case, the device D includes a pair of groups of pusher means 90, situated beside the packaging line C and downstream of the part of the latter relevant to the folding means 70, 74, 75, as schematically shown in FIG. 6.

The pusher means 90 of each of these groups are situated crosswise to the forward movement direction W of the packaging line C and are moved by operating means 91 to translate 92, in the forward movement direction W, and alternatively, in step relation with the movement of the package along the packaging line C, respectively moving close 93 to the packaging line C, in order to abut against the twisted edges 11 of the sheet wrapping the package 10, so as to fold them and close them introducing them into the ends 15 of the rigid core 14 of the roll enclosed in the package 10, and to move away 94 from the packaging line C, so as to free the side ends of the package.

The moving means 91 can include, as shown for example in FIG. 6, an endless conveyor 95, situated parallel to the packaging line C and having transversal guides 96.

Carriages 97, to which the pusher means 90 are connected, are introduced slidingly inside the guides 96.

The carriages 97 of each conveyor 95 are displaced by relative pins 98, moved by the conveyor 95 along a cam path 99, extending, likewise endless, within the loop-path of the conveyor 95.

The cam path 99 operates the pusher means 90 to move alternately close to 93 the packaging line C and away 94 therefrom, due to the crosswise sliding of the carriages 97 within the corresponding guides 96 during the translation 92, operated by the conveyor 95 via the pins 98.

Figure 7:
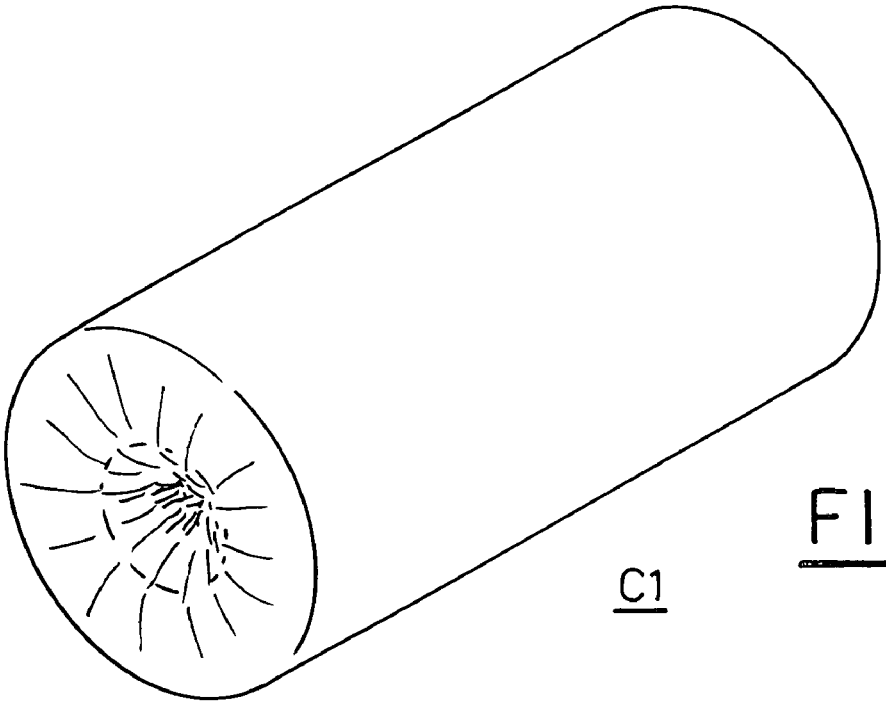
FIG. 7 is a perspective view of a package formed by one roll, with the protection wrapping made of flexible, paper material, with side ends twist-folded by the device proposed by the present invention as shown in FIG. 6.

The obtained package Cl has the configuration shown in FIG. 7, with the desired twist-folding effect at the side ends, which are introduced into the stiffening core of the packaged roll.

According to another possible embodiment of the device D, in case of packaging by heat-weldable flexible material, the stationary folding means 70 include two vertical boards 76, each of which is situated beside the packaging line, parallel to the forward movement direction W, and positioned with respect to the packaging line C in such a way as to hit only the protruding edges 11 of the sheet wrapping the package 10, moved to translate and rotate along the packaging line C by the operating means 20.

Figure 4:
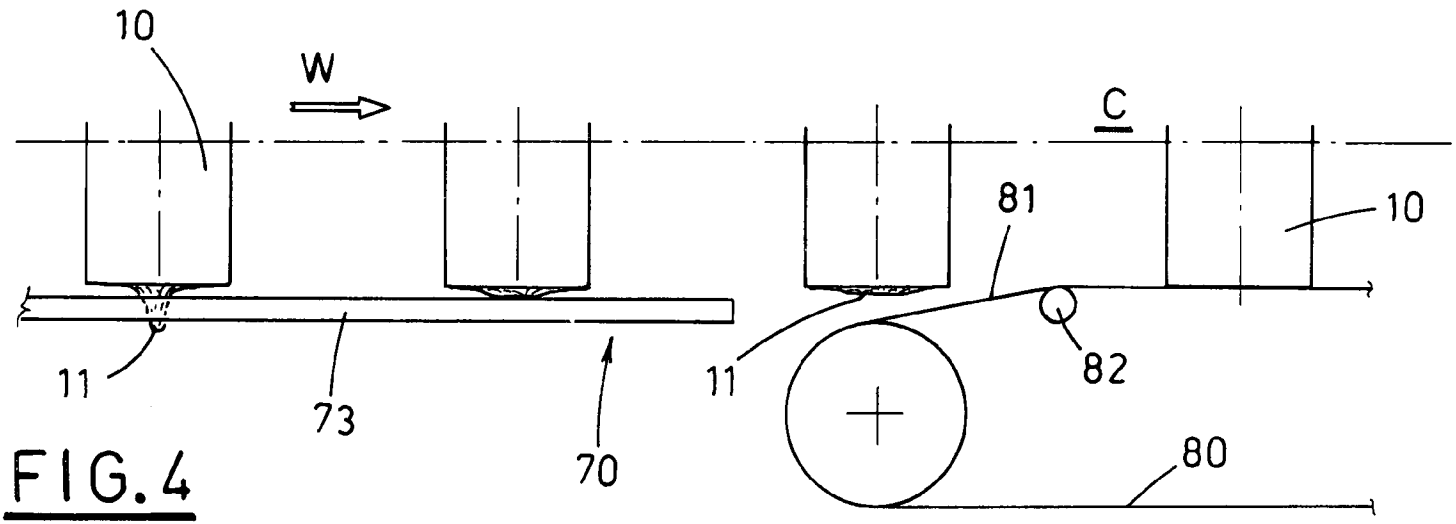
FIG. 4 is a top view of the device shown in FIG. 3.

The height of the upper edge 73 of each of the boards 76 increases continuously, according to the forward movement direction W, from a minimum height value to a maximum height value, substantially corresponding to the package 10 radius, so as to fold, during the package forward movement along the packaging line C, the edges 11, which are twisted, toward the side ends of the roll of the package (as it has been well shown in FIGS. 3 and 4).

According to a further embodiment of the device D, not shown in the enclosed figures, but remaining within the present invention, the working means 20 include a lower abutment surface, which defines the forward moving surface of the packaging line C, and an endless conveyor, situated above and parallel to the abutment surface.

This conveyor receives the package 10 coming from the inlet section I and tightly holds it between its lower active run 22 and the abutment surface, touching only the cylindrical surface 30 of the package.

The lower active run 22 is operated in the same direction as the forward movement direction W of the packaging line C and moves and rotates the package 10 with respect to the lower abutment surface.

According to a still further embodiment, the operating means 20 include an endless conveyor, which defines the forward moving surface the packaging line C and an abutment surface, situated above and parallel to the conveyor.

Like in the previous case, the conveyor receives the package 10 coming from the inlet section I and holds it tightly between the upper active run 21 and the upper abutment surface.

The upper active run 21 is operated in the same direction as the forward movement direction W of the packaging line C and moves and rotates the package 10 with respect to the upper abutment surface.

Consequently, the device D proposed by the present invention, in various embodiments described previously, acts on the packages 10 touching only their outer cylindrical surfaces and moves the packages 10 so that it translates rotating in the forward movement direction W of the packaging line C, which is necessary to twist the edges at the side ends due to the edges of the folding means.

This is obtained by the use of a pair of endless belt conveyors, parallel, adjustable and situated one above the other at adjustable heights, operated with different working speeds (or by one endless conveyor connected to a stationary abutment surface).

Therefore, the use of endless conveyors operated with different speeds allows to move the packages, whose heads are to be twisted, so as to translate rotating with respect to the stationary folding means without using otherwise necessary operating means situated beside and outside the packaging line, as in the prior art.

This allows also to use stationary folding means, whose height changes without any limits, as described above, obtaining a more efficient closing of the side ends against the external ends of the roll (or the ends of the external rolls of the row of rolls) of the package.

Moreover, it is to be pointed out that the device D, due to its particularly functional and versatile structure and by the adjustment of the distance between the conveyors, can be used in packaging machines of different configurations and designed for packaging different sizes of packages, without requiring substantial structural changes.

Another advantage derives from the fact that the device D proposed by the present invention is particularly suitable to be used with packaging machines having configuration described in the previously mentioned Patent Applications, respectively DE 10157992 (FIGS. 1 and 3) and DE 10157952 (FIG. 8), because it is designed to be installed rapidly on these machines, without any adapting and/or substantial structural changes of the latter.

It is understood that the proposed invention has been described, with reference to the enclosed figures, as a pure, not limiting example. Therefore, all possible changes and variants of the invention suggested by the use, are to be considered within the protective scope of the present invention solution, as described above and claimed hereinbelow.

The invention claimed is:

1. A device for closing side ends of packages including only one roll or one row of rolls of material in an automatic packaging machine, with the packaging machine including:

a station for preparing a roll or a row of rolls arranged one beside another, to be packaged by wrapping with a sheet of flexible material to form a protective wrapping;

means for transferring said roll or row of rolls along a transfer path from said preparing station to an inlet section of a packaging line operated in a forward movement direction;

means for positioning a packaging sheet in stretched configuration and crosswise to the transfer path of said roll or row of rolls from said preparing station to said inlet section; and wrapping means and folding means situated along said transfer path for wrapping the sheet around said roll or row of rolls to form a tubular partial package with edges of said sheet extending sideways beyond the side ends of the package still open, with said inlet section transferring said partial package to the packaging line with the side ends of the package being parallel to said forward movement direction;

wherein said device includes operating means connected to said packaging line and acting only on an outer cylindrical surface of said package for translating and rotating said package in said forward movement direction, and stationary folding means, situated beside said packaging line with a configuration to hit only said side ends of said package, so that said side ends, during the motion of said package along said packaging line, hit, in rotation-translation, edges of said stationary folding means thus becoming twisted.

2. A device as claimed in claim 1, wherein said operating means include a pair of parallel endless conveyors arranged one above the other, a lower conveyor and an upper conveyor respectively, defining said packaging line and receiving said partial package, coming from said inlet section, between active runs, upper run of the lower conveyor and lower run of the upper conveyor respectively, so as to hold tightly the package therebetween touching only said outer cylindrical surface, with the upper run of the lower conveyor operated in a direction identical with said forward movement direction, at an operating speed different from an operating speed of the lower run of the upper conveyor having direction likewise identical to the forward movement direction, so as to translate and rotate said package along said packaging line.

3. A device as claimed in claim 2, wherein the operating speed of the upper run of the lower conveyor is lower than the operating speed of the lower run of the upper conveyor.

4. A device as claimed in claim 2, wherein the operating speed of the upper run of the lower conveyor is higher than the operating speed of the lower run of the upper conveyor.

5. A device as claimed in claim 1, wherein said operating means include a lower abutment surface, defining a forward moving surface of said packaging line, and an endless belt conveyor, arranged parallel and above said abutment surface for receiving said partial package coming from said inlet section and hold tightly said package between the lower active run and said abutment surface, touching only said outer cylindrical surface of the package, with the lower active run of said conveyor being operated in the same direction as the forward movement direction, so as to translate and rotate said package, with respect to said abutment surface, in the forward movement direction.

6. A device as claimed in claim 1, wherein said operating means include an endless belt conveyor, defining a forward moving surface of said packaging line, and an upper abutment surface, arranged parallel and above said belt conveyor, with the belt conveyor receiving said partial package coming from said inlet section and holding tightly said package between the upper active run and said abutment surface, touching only the said outer cylindrical surface of the package, with the upper active run of said conveyor being operated in the same direction as the forward movement direction, so as to translate and rotate said package, with respect to said abutment surface, in the forward movement direction.

7. A device as claimed in claim 1, wherein said stationary folding means include, on both sides of said packaging line, a pair of vertical boards, arranged one above the other, a lower board and an upper board, respectively, with each board being parallel to the forward movement direction of the packaging line, so as to hit only the protruding edges of the sheet wrapping said package, translated rotating on the packaging line by said operating means, with the height of the upper edge of the lower board increasing continuously, considering said forward movement direction, from a minimum height value to a maximum height value, smaller than the package radius, and with the height of the lower edge of the upper board increasing continuously, considering said forward movement direction, from a minimum height value to a maximum height value, smaller than the package radius and substantially corresponding to the maximum height of the edge of the lower board, with said upper edge and lower edge defining, in the region where their heights is higher, a guiding channel, which conveys said edges which become twisted.

8. A device as claimed in claim 1, wherein said stationary folding means include a pair of vertical boards, situated on both sides of the packaging line, parallel to the forward movement direction, and positioned with respect to the packaging line in such a way as to hit only the protruding edges of the sheet wrapping said package translated and rotated along the packaging line by said operating means, with the height of the upper edge of the board increasing continuously, according to the forward movement direction, from a minimum height value to a maximum height value, substantially corresponding to the package diameter, so as to fold, during the package forward movement along the packaging line, the twisted edges toward the side ends of the package.

9. A device as claimed in claim 1 wherein said package is wrapped within a sheet of heat-weldable flexible material, and the device includes a pair of endless welding belts situated beside said packaging line, downstream of said stationary folding means, in such a way that a working surfaces of the welding belt contact the twisted edges of said package moving forward along the packaging line, to heat weld them and close them to complete the package.

10. A device as claimed in claim 9, wherein the working surfaces of said welding belts are is guided by roll means, in abutment against the side ends of said package moving along said packaging line, so as to compact the welded edges against the side ends of the package.

11. A device as claimed in claim 1, wherein the package is wrapped with a sheets of paper flexible material, and the device includes a pair of groups of pusher means situated beside said packaging line and downstream of said stationary folding means, with the pusher means of each of these groups moving crosswise to said forward movement direction and being moved by operating means so as to translate, in the forward direction in registry with the package along said packaging line, and moving at the same time first close to said packaging line, in order to abut against the twisted edges and fold and introduce the edges into the side ends of the support core if the roll or of the external rolls of said row, to complete the package, and then away from said line, so as to free a completed package.

12. A device as claimed in claim 11, wherein said moving means of each group of pusher means include an endless conveyor, situated parallel to said packaging line and having transversal guides, inside which carriages slide, with the pusher means connected thereto, with said carriages being guided by relative pins sliding along an endless cam path extending within the conveyor, and with the cam path being such as to operate the pusher means to move alternately close to and away from said packaging line, by sliding of the carriages within the corresponding guides during the translation.

* * * * *